US006382412B1

(12) United States Patent
Wood

(10) Patent No.: US 6,382,412 B1
(45) Date of Patent: May 7, 2002

(54) BLISTERED ARTICLE PROTECTIVE EXHIBITOR PACKAGE

(76) Inventor: Cliff Wood, Bob Hill Rd., Pound Ridge, NY (US) 10576

( * ) Notice: Subject to any disclaimer, the term of this patent is extended or adjusted under 35 U.S.C. 154(b) by 0 days.

(21) Appl. No.: 09/769,693

(22) Filed: Jan. 25, 2001

Related U.S. Application Data

(60) Provisional application No. 60/177,910, filed on Jan. 25, 2000.

(51) Int. Cl.[7] ..... B65D 69/00

(52) U.S. Cl. ..... 206/232; 206/534; 206/538; 229/115; 229/117.01; 248/152; 283/56

(58) Field of Search ..... 206/232, 449, 206/461, 526, 531, 532, 534, 538, 539, 767; 211/50; 229/115, 117.01, 117.27; 248/152; 283/56

(56) References Cited

U.S. PATENT DOCUMENTS 1,713,758 A * 5/1929 Horwath ..... 248/152
1,949,376 A * 2/1934 Mansfield ..... 206/767
2,975,905 A * 3/1961 Foland ..... 211/50
3,471,006 A * 10/1969 Tempelhof ..... 229/115
4,917,240 A * 4/1990 Roberts et al. ..... 206/232
5,083,700 A * 1/1992 Mello et al. ..... 229/115
5,458,242 A * 10/1995 Baka et al. ..... 211/50
5,782,452 A 7/1998 Bosworth
5,803,499 A * 9/1998 Tung et al. ..... 283/56
5,901,844 A 5/1999 Gambardella et al.
6,063,416 A * 5/2000 Teasdale et al. ..... 229/117.27

* cited by examiner

*Primary Examiner*—Jim Foster
(74) *Attorney, Agent, or Firm*—Cohen, Pontani, Lieberman & Pavane

(57) ABSTRACT

A display easel for displaying literature and holding a blister pack is disclosed. The display easel has a cover flap to cover a literature display panel. Both the literature display panel and the cover flap are connected to a blister pack panel positioned behind the literature display panel. At the opposite end of the display easel from the connection between the cover flap, the literature display panel, and the blister pack panel, a bottom is formed by attaching a base section to the bottoms of the literature display panel and the blister pack panel. There are pockets in the literature display panel and the blister pack panel into which literature and a blister pack, respectively, may be inserted In one aspect of the present invention, all of these sections are formed from a unitary sheet of paperboard material.

36 Claims, 5 Drawing Sheets

BLISTERED ARTICLE PROTECTIVE EXHIBITOR PACKAGE

RELATED APPLICATIONS

This application claims priority from U.S. Provisional Patent Application Serial No. 60/177,910 which was filed on Jan. 25, 2000.

BACKGROUND OF THE INVENTION

1. Field of the Invention

This invention relates to a package for distributing and exhibiting medical literature along with sample blister packages of medication.

2. Description of the Related Art

Pharmaceutical companies promote the use of their medications by providing samples of the medications to medical practitioners (doctors, hospitals, etc.) for distribution to their patients. The samples are supplied in various known forms of distribution such as small bottles or boxes of blister packs, and the doctors typically store the samples in a cabinet or closet. Promotional literature for the medications is often displayed on a stand in the doctors' waiting areas without the sample medications.

There is a need for a package which combines both a blister pack of medication and associated promotional product literature and which can be used to prominently display the literature in a doctor's office and then easily distributed by the doctor to a patient to be taken home by the patient.

SUMMARY OF THE INVENTION

In accordance with an embodiment of the present invention, a protective package is provided for the combined distribution and display of blister packs of articles, such as medications, in association with product literature and promotional information. The package has a first panel with a first pocket for securely holding one or more blister packs without crushing the articles in the blister pack. A plurality of holes are positioned across the front of the first pocket such that each blister in the blister pack is accommodated within one of the holes, thereby securing the blister pack in the first pocket. A second panel is flexibly attached to the top of the first panel and folds in front thereof. The second panel has a second pocket to store and display literature relating to the articles in the first pocket. A cover is flexibly attached to the tops of the first and second panels. The cover may have graphics with further product or manufacturer information or advertising attached thereto or printed thereon.

A bifold flap is flexibly attached to the bottom of the second panel. A tab at the bottom of the flap is insertable into a slot on the bottom of the first panel to hold the bottoms of the first and second panels away from one another a sufficient distance to form an easel. The flap may be folded inward between the first and second panels to allow the three panels to be folded into a substantially flat package for compact distribution.

The entire package may be made from a single sheet of laminated paper that is sturdy but flexible enough to prevent the articles from getting crushed when the package is folded flat. A second plurality of holes may be provided on the back of the first panel to show a printed expiration date and lot number on the blister pack.

Other objects and features of the present invention will become apparent from the following detailed description considered in conjunction with the accompanying drawings.

It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
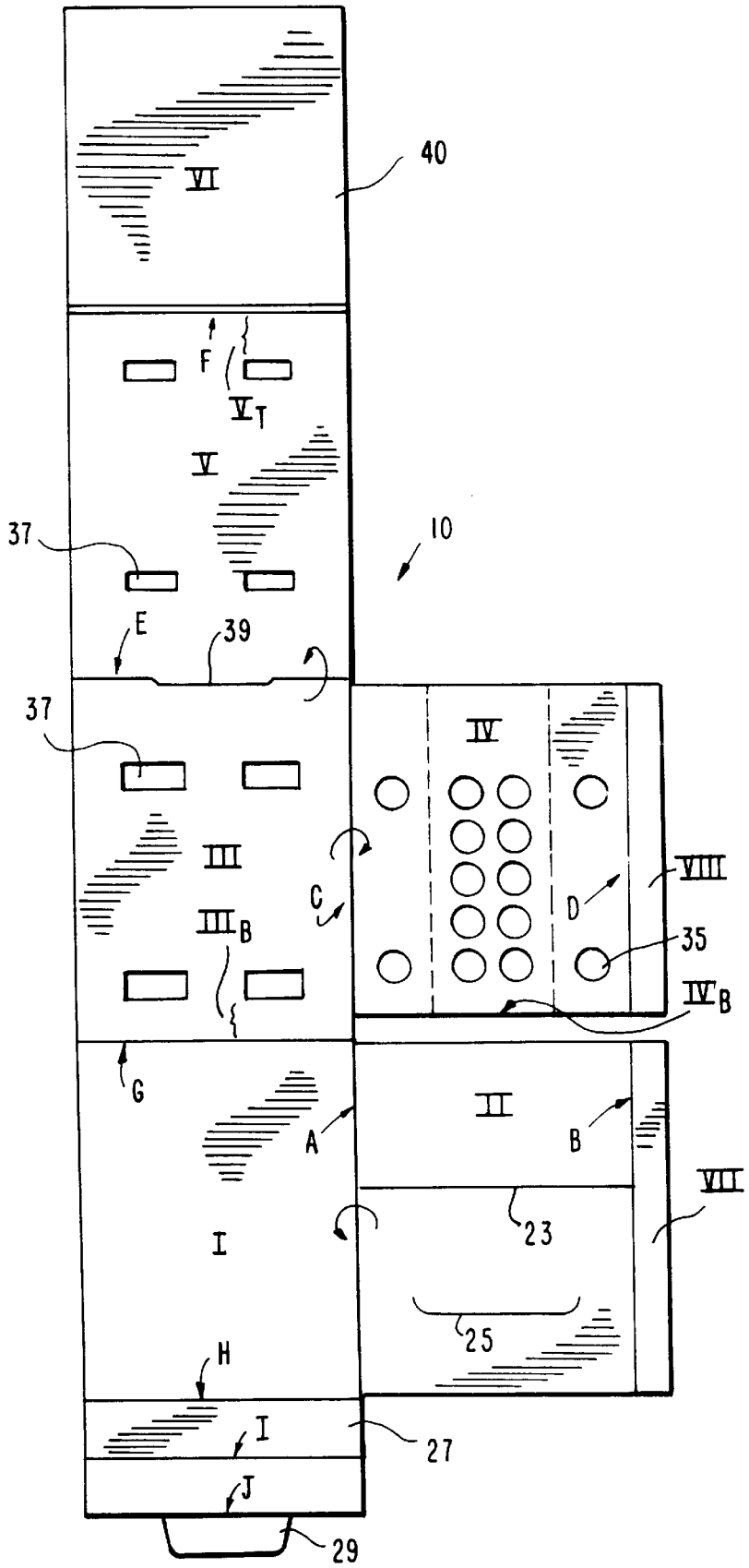
FIG. 1 is a plan view of a single paper sheet cut so as to construct a package according the present invention.

Referring to FIG. 1, a package 12 for distributing and displaying medication and product or manufacturer literature in accordance with the invention may be assembled from a single sheet 10 of laminated paper which should be sufficiently thick so as to securely hold and protect a blister pack of medication without breakage. The sheet is cut out in the shape illustrated and includes creases A-J to permit ease of folding of the sheet into the desired package. To more conveniently indicate the manner in which package 12 is assembled from sheet 10, sections of sheet 10 are marked in the drawings with Roman Numerals I–VIII. Sections I, III, V, and VI are contiguous with respective creases G, E, and F formed between adjacent sections. Section II is contiguous with section I and section IV is contiguous with section III, but sections II and IV are not themselves contiguous so that they can be folded separately and form separate pockets, one for the blister pack and one for related literature.

Figure 2:
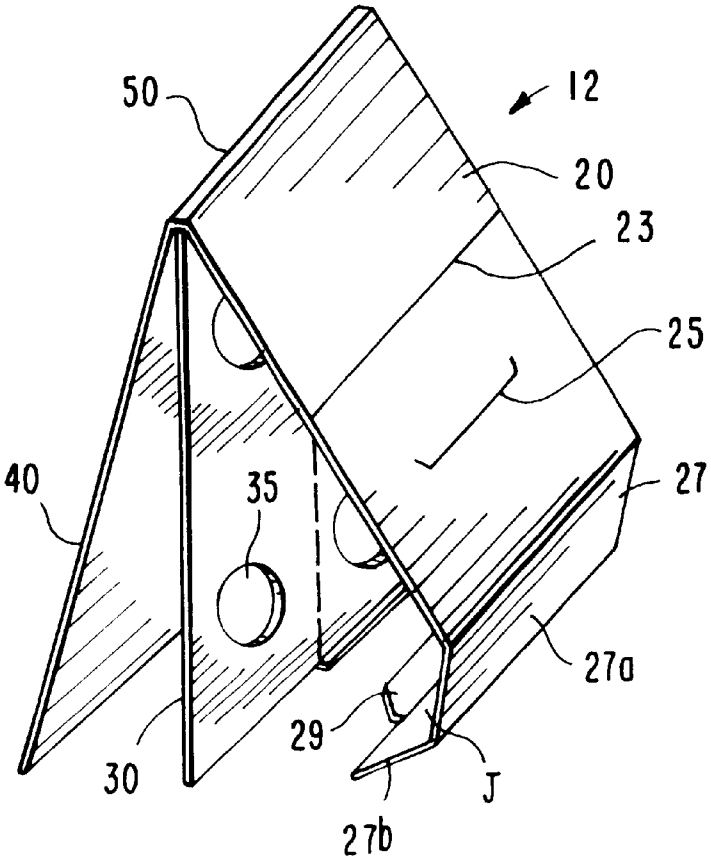
FIG. 2 is a perspective view of the front of the package constructed from the paper sheet shown in FIG. 1 but not assembled for display.

Viewing FIG. 1 with section VI shown at the top, sheet 10 is folded as follows: Section VII is folded upward and leftward along crease B toward section II, and section II is folded upward and leftward along crease A onto section I. Section VII is then affixed to section I with adhesive, thereby forming a panel 20 having a pocket, into which literature may be inserted, formed between sections I and II (FIG. 2).

Next, section VIII is folded backward along crease D, and section IV is folded backward along crease C and under section III. Adhesive placed between section VIII and the underside of section III forms a panel 30 having a pocket for the blister pack. Sufficient space is left between the bottom of section IV ($IV_B$), which forms the top of the pocket 33 (FIG. 5) into which the blister pack is inserted, and crease G for easier insertion and removal of the blister pack.

Figure 3:
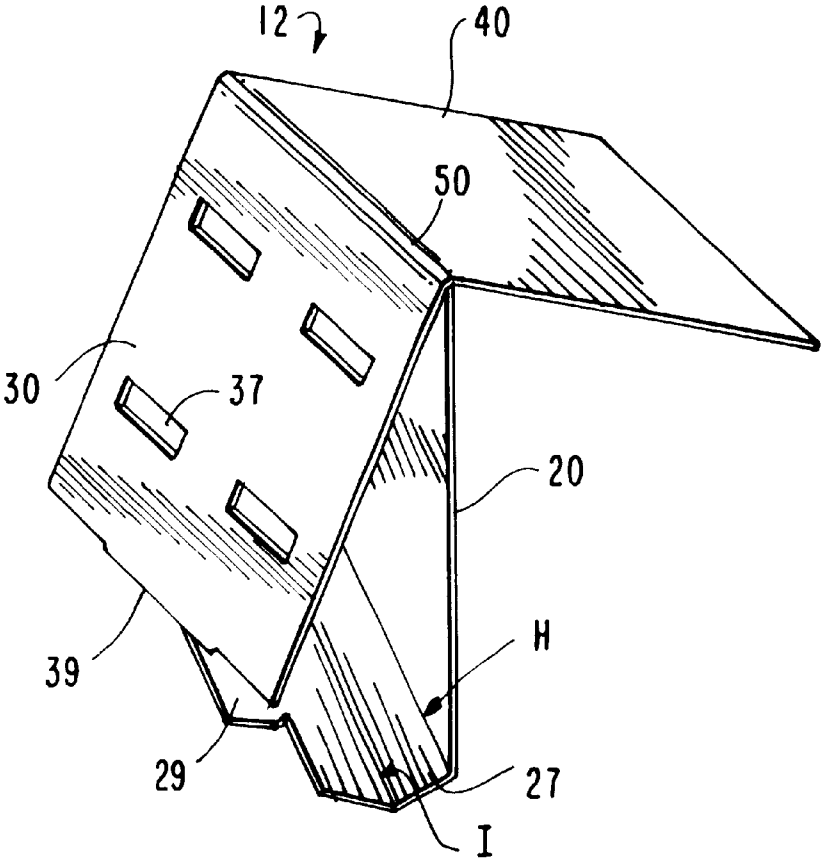
FIG. 3 is a rear view of the package not assembled for display.

With section IV secured to the underside of section III, section V is folded upward and forward along crease E and against the top of section III, thereby bringing creases F and G into proximity with one another. Sections III and V are secured to one another with adhesive placed near the side edges of the sections and along the edges $III_B$ and $V_T$ of sections III and V. In the final constructed package, the connections between these edges and the attached edge of Section VI form an apex 50. Section VI is either folded forward and downward along crease F to create cover 40 (FIG. 3) to cover panel 20, or is folded backward to expose literature inserted through the front of panel 20 (FIG. 2). (Section VI is shown as a single layer of laminated paper but may instead be formed from a double layer of paper created, for example, by adding an additional section (not shown) of similar size to section VI at the top of sheet 10 and contiguous with section VI. That additional section would be folded over onto section VI and affixed thereto with adhesive to form the double-thickness panel.)

Figure 5:
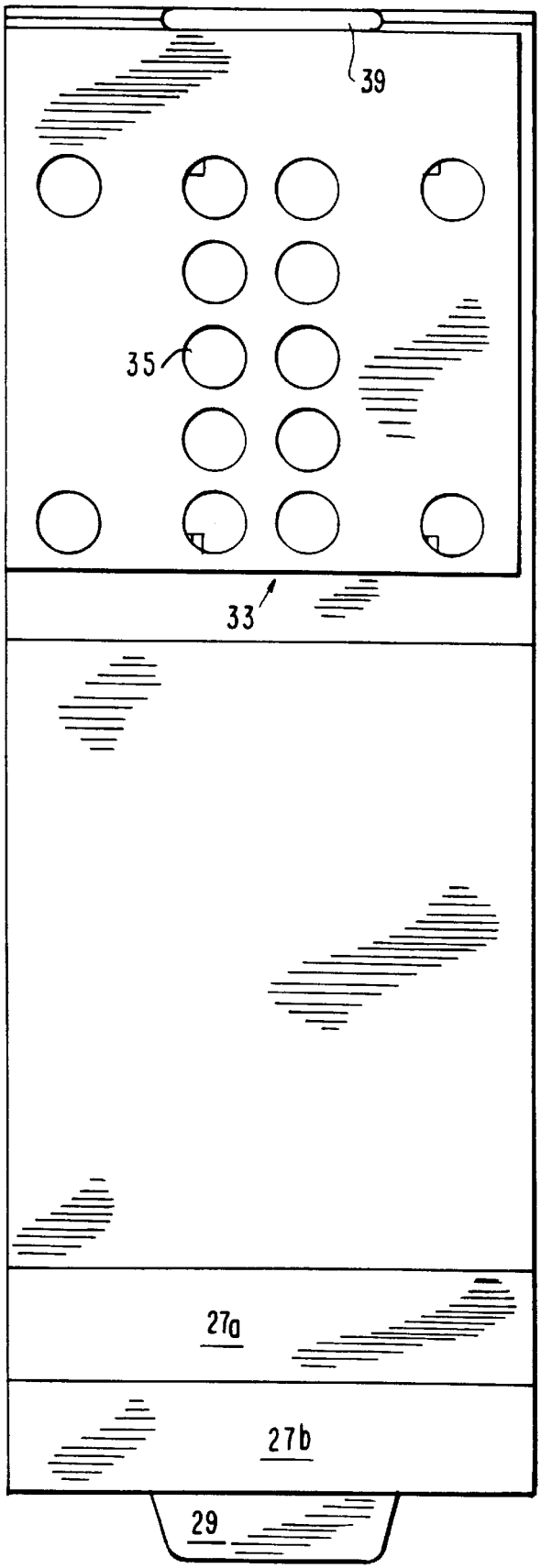
FIG. 5 is a plan view of the inside of the package fully opened to expose a pocket for holding blister packs.
Figure 6:
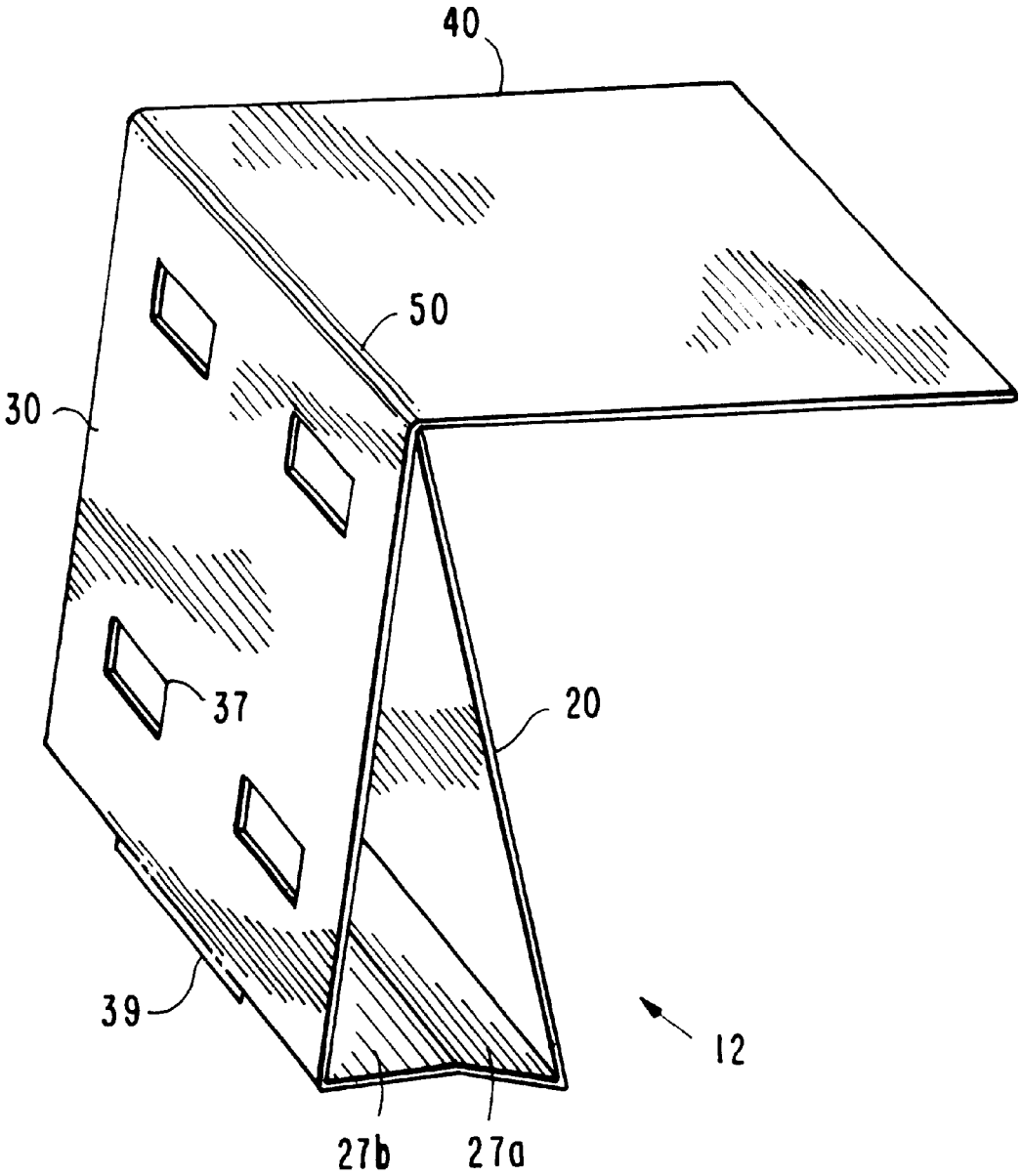
FIG. 6 is a rear perspective view of the package assembled for display.

Referring now to FIG. 5, a blister pack may be inserted into the top of pocket 33 on panel 30 with the back of the blister pack facing the rear of the pocket. Holes 35 are positioned on section IV in a pattern that corresponds to the arrangement of blisters on the particular blister pack to be inserted in pocket 35 such that, when the blister pack is fully inserted in pocket 35, a respective individual blister projects outwardly from each hole. In this manner, the blister pack can be firmly and protectively retained in the pocket. Those of ordinary skill in the art will recognize that the illustrated pattern, sizing, and number of holes 35 is shown by way of example only as illustratively suitable for a blister pack having a corresponding arrangement of blisters. Thus, the invention is not intended to be limited to the particular illustrated pattern, size, or number of holes 35 shown; the actual pattern, size, and number of holes 35 will vary to accommodate the particular layout of the blisters on a blister pack to be accommodated by the inventive package. Moreover, while distributing blister packs for medication is one especially contemplated use for this invention, it should be understood that blister packs and the like containing other articles may also be employed within the scope of the present invention.

Optionally, holes 37 are placed on sections III and V so that a lot number and expiration date of the medication typically, as are stamped on the back of a blister pack, are visible. The proper positioning of the holes 37 will depend on the location at which the information is stamped on the back of the particular blister packs.

Figure 4:
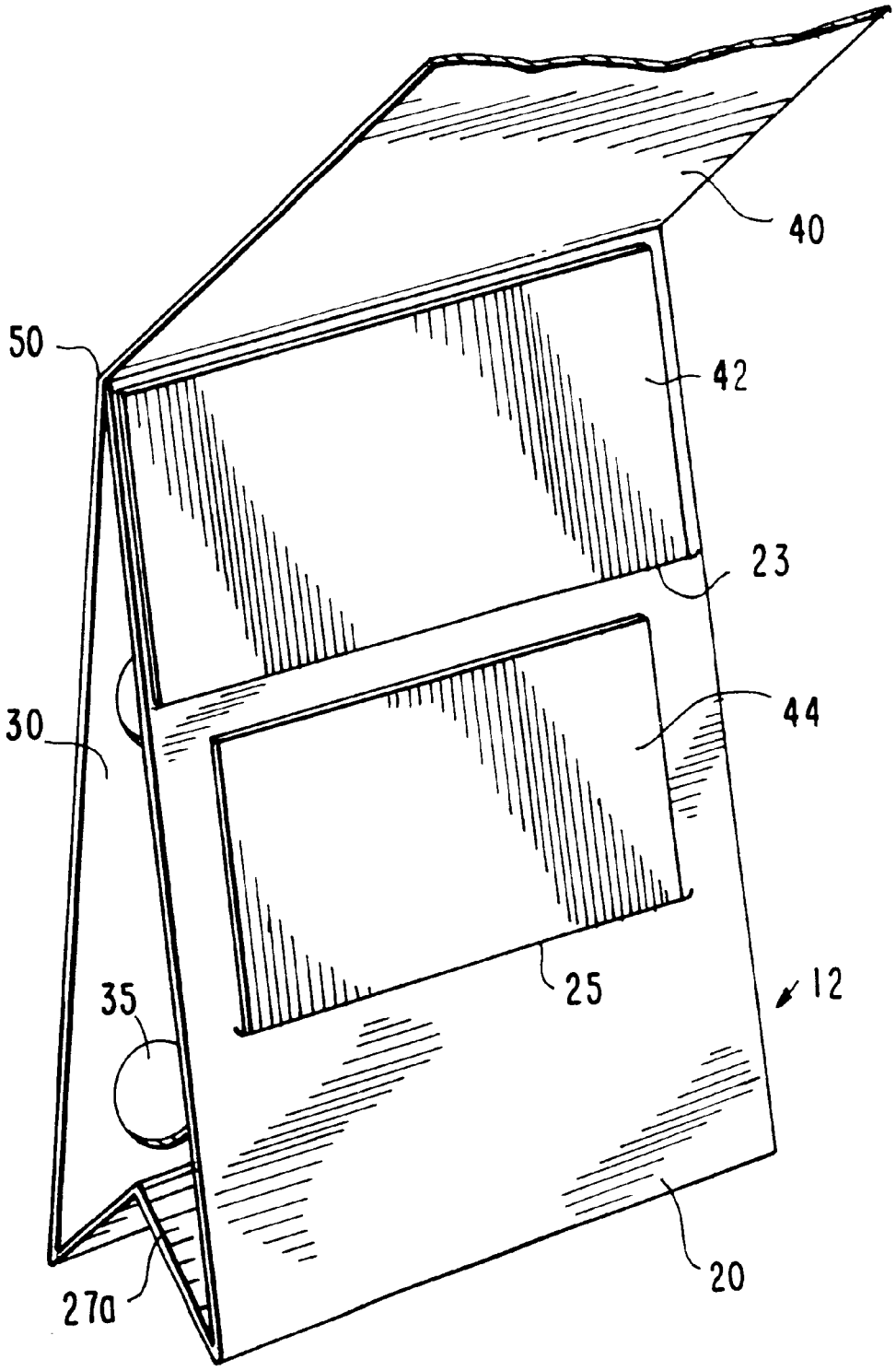
FIG. 4 is a front perspective view of the package with the package assembled to form an easel to display product literature inserted therein.

Literature, whether about the product in the blister pack and/or the manufacturer, or otherwise, is insertable in the pocket formed by panel 20. This pocket may have two openings 23, 25 as shown in FIG. 4 into which separate pieces of literature 42, 44 can be inserted. The upper opening 23 is defined by a slit extending from the right to the left sides of section II which now forms the front of panel 20. The lower opening 25 is formed by a second slit in section II. An alternate arrangement of one or more such openings for accommodating the insertion of literature may be substituted for the illustrated construction.

The package may be assembled into an easel for displaying the literature inserted in panel 20. Toward that end, a bifold flap 27 of laminated paper is formed contiguous with section I and bends backward along crease H towards panel 30. Flap 27 comprises subsections 27*a* and 27*b* which are bent slightly toward one another along crease I. A tab 29 extending from subsection 27*b* is inserted into a slot 39 at the bottom of panel 30 formed between sections III and V. This engagement serves to hold the bottoms of panels 20 and 30 predeterminately apart from one another to form an easel. The easel may be set up for display in a doctor's waiting room or on a doctor's desk with the cover 40 folded behind panel 30 to expose the literature in panel 20, or cover 40 may be folded in front of panel 20 to display graphics, such as advertising, on cover 40.

The easel may also be folded into a flat protective package for a patient to carry home from a doctor's office or for mailing to a patient by a pharmaceutical company. To form the flat protective package with blister pack and literature enclosed, flap 27 is folded inward between panels 20 and 30 along crease I and panels 20 and 30 and cover 40 are flattened against one another. The lower edges of panels 20 and 30 and cover 40 are taped or otherwise secured together. The protective package thus formed, including the extra padding created by the folded flap 27 between the bottom of panels 20 and 30, holds the medication securely so the blister pack and medication are not damaged and provides a convenient way to distribute related literature.

While a multifunction package has been described which is formed, as is preferred, from a single sheet or blanks of paper, the invention is not intended to be limited to this construction and alternatively may be formed from multiple sheets of paper or from other suitable materials to form the desired combination package that can advantageously be used for the distribution and display of blister-packaged articles and related literature.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention.

For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A display easel for holding a blister pack and for displaying literature, said display easel having a portion facing forward and a portion facing backward, comprising:

a base having a front edge and a back edge;

a literature display panel connected at a bottom edge to the front edge of the base and connected at a top edge to an apex, said literature display panel having a back side and a front side defining a pocket facing forward and into which literature may be inserted;

a blister pack holding panel connected at a bottom edge to the back edge of the base and connected at a top edge to the apex, said blister pack holding panel having a front side and a back side, said front side having a pocket facing forward into which a blister pack may be inserted;

a cover panel hingedly connected at a bottom edge to the apex, said cover panel having a front side and a back side; and the apex comprising an approximate connection between the bottom edge of the cover panel, the top edge of the literature display panel and the top edge of the blister pack holding panel;

the cover panel may be folded over at the hinged connection to the apex so as to lay upon the front side of the literature display panel; and wherein, when the cover panel is folded over onto the front side of the literature display panel, the front side of the cover panel faces forward and the back side of the cover panel faces the front side of the literature display panel.

2. The display easel of claim 1, wherein the cover panel may be folded over at the hinged connection to the apex so as to lay upon the back side of the blister pack holding panel such that the back side of the cover panel faces backward and the front side of the cover panel faces the back side of the blister pack holding panel.

3. The display easel of claim 1, wherein said display easel is formed of a unitary sheet of paperboard material.

4. The display easel of claim 1, wherein the approximate connection of the apex comprises:

a hinged connection between the bottom edge of the cover panel and the top edge of the blister pack holding panel, wherein the cover panel and the blister pack holding panel are integrally formed and the hinged connection is along a common fold line between the cover panel and the blister pack holding panel; and a literature display panel connection comprising one of:

a glued connection between the top edge of the literature display panel and a line defined on a side of the integrally formed cover panel and blister pack holding panel, wherein said line is located approximate to, and parallel with, the common fold line and said side comprises the front side of the blister pack holding panel and the back side of the cover panel;

a friction connection between the top edge of the literature display panel and the integrally formed cover panel and blister pack panel, wherein the friction connection is made by placing the top edge of the literature display panel into a bend formed at a line defined on a side of the integrally formed cover panel and blister pack holding panel, wherein said line is located approximate to, and parallel with, the common fold line and said side comprises the front side of the blister pack holding panel and the back side of the cover panel; and a tab and slot connection between a tab formed on the top edge of the literature display panel and a slot formed in the integrally formed blister pack holding panel and cover panel, wherein said slot is located approximate to, and parallel with, the common fold line.

5. The display easel of claim 1, further comprising:

a backing panel having a top edge, a front side, and a back side, said top edge being connected to the apex, where said backing panel is connected to the blister pack holding panel so that the front side of the backing panel lies flat upon the back side of the blister pack holding panel;

wherein the approximate connection of the apex comprises:

a hinged connection between the bottom edge of the cover panel and the top edge of the backing panel, wherein the cover panel and the backing panel are integrally formed and the hinged connection is along a common fold line between the cover panel and the backing panel; and a literature display panel connection comprising one of:

a glued connection between the top edge of the literature display panel and a line defined on a side of the integrally formed cover panel and backing panel, wherein said line is located approximate to, and parallel with, the common fold line and said side comprises the front side of the backing panel and the back side of the cover panel;

a friction connection between the top edge of the literature display panel and the integrally formed cover panel and backing panel, wherein the friction connection is made by placing the top edge of the literature display panel into a bend formed at a line defined on a side of the integrally formed cover panel and backing panel, wherein said line is located approximate to, and parallel with, the common fold line and said side comprises the front side of the backing panel and the back side of the cover panel; and a tab and slot connection between a tab formed on the top edge of the literature display panel and a slot formed in the integrally formed cover panel and backing panel, wherein said slot is located approximate to, and parallel with, the common fold line.

6. The display easel of claim 1, wherein the connection between the front edge of the base to the bottom edge of the literature display panel comprises:

a hinged connection between the bottom edge of the literature display panel and the front edge of the base, wherein the literature display panel and the base are integrally formed and the hinged connection is along a common fold line between the literature display panel and the base.

7. The display easel of claim 1, wherein the connection between the back edge of the base to the bottom edge of the blister pack holding panel comprises:

a slot formed at the bottom edge of the blister pack holding panel;

a tab formed at the back edge of the base;

wherein said tab is inserted into said slot to form a releasable engagement.

8. The display easel of claim 1, wherein the pocket of the blister pack holding panel has at least one hole positioned in a pattern that corresponds to an arrangement of at least one blister on a front side of a blister pack to be inserted such that, when said blister pack is fully inserted in the pocket of the blister pack holding panel, each of said at least one blister projects outward from one of said at least one hole.

9. The display easel of claim 1, wherein the back side of the blister pack holding panel has at least one hole positioned in a pattern that corresponds to an arrangement of at least one blister pack information on a back side of a blister pack to be inserted such that, when said blister pack is fully inserted in the pocket of the blister pack holding panel, each of said at least one blister pack information is visible from the back side of the blister pack holding panel.

10. The display easel of claim 9, wherein the blister pack information comprises one of an expiration date of material in the blister pack, graphics, advertising, and a lot number of material in the blister pack.

11. The display easel of claim 1, wherein the pocket in the literature display panel is formed so that a portion of a piece of literature inserted in said pocket is visible when the cover panel is one of not lying upon the front side of the literature display panel and either lying or not lying upon the front side of the literature display panel.

12. The display easel of claim 1, wherein the blister pack holding panel comprises:

a front section forming at least a portion of the front side of the blister pack holding panel; and a back section forming the back side of the blister pack holding panel;

wherein, when said front section and said back section are attached to make the blister pack holding panel, the pocket in the blister pack holding panel is formed by said front section and said back section.

13. The display easel of claim 1, wherein the literature display panel comprises:

a front section forming at least a portion of the front side of the literature display panel; and a back section forming the back side of the literature display panel;

wherein, when said front section and said back section are attached to make the literature display panel, the pocket in the literature display panel is formed by said front section and said back section.

14. The display easel of claim 1, wherein the cover panel has cover panel information, said cover panel information being one of attached to and printed on a side of the cover panel.

15. The display easel of claim 14, wherein the cover panel information comprises one of graphics, advertising, and information about material in a blister pack which is inserted in the pocket of the blister pack holding panel.

16. The display easel of claim 1, wherein the base has a fold line such that, when the base is bent along said fold line, the display easel collapses into a form where the blister pack holding panel, the literature display panel, and the cover panel are substantially flattened against one another.

17. The display easel of claim 1, wherein a slit is formed in the front section of the literature display panel whereby an additional pocket is formed when the front and back literature display sections are attached to make the literature display panel.

18. A display easel for holding a blister pack and displaying literature, wherein said display easel is formed of a unitary sheet of paperboard material and, when constructed, said display easel has a top, bottom, front, and back, the display easel comprising:

a base having a front edge, a back edge, and a tab, said tab being hingedly connected along a common fold line with said back edge;

a first literature display section having a front side, a bottom edge hingedly connected along a common fold line with the front edge of the base, a top edge, and an inner side edge;

a second literature display section having an inner side edge hingedly connected along a common fold line with the inner side edge of the first literature display section, an outer side edge, and a tab, said tab being hingedly connected along a common fold line with the outer side edge;

a first blister pack holding section having a front side, a back side, a top edge hingedly connected along a common fold line with the top edge of the first literature display section, a bottom edge, and an inner side edge, where said front side of the first blister pack holding section is on an opposite side of the sheet of paperboard material as the front side of the first literature display section;

a second blister pack holding section having a top edge, an inner side edge hingedly connected along a common fold line with the inner side edge of the first blister pack holding section, an outer side edge, and a tab, said tab being hingedly connected along a common fold line with the outer side edge;

a third blister pack holding section having a bottom edge hingedly connected along a common fold line with the bottom edge of the second blister pack holding section section and a top edge, where said common fold line has a slot; and a cover panel having a top edge hingedly connected along a common fold line with the top edge of the third blister pack holding section, said cover panel having a front side and a back side;

whereby a literature display panel having a back side and a pocket side is created by folding the first and second literature display sections at their common fold line, attaching the second literature display section to the first literature display section by affixing the tab of the second literature display section to the front side of the first literature display section, wherein a literature display pocket is formed on the pocket side of the literature display panel;

whereby a blister pack holding panel having a back side and a pocket side is created by folding the first and second blister pack holding sections at their common fold line, attaching the second blister pack section to the first blister pack section by affixing the tab of the second blister pack section to the front side of the first blister pack section, folding the second and third blister pack holding sections at their common fold line, attaching the third blister pack section and the first blister pack section, wherein a blister pack pocket is formed on the pocket side of the blister pack holding panel;

whereby the base is attached to the blister pack holding panel by inserting the tab of the base into the slot of the common fold line between the second and third blister pack sections; and whereby the cover panel may be folded over at the common fold line between the cover panel and the third blister pack section so as to cover at least a portion of the pocket side of the literature display panel.

19. The display easel of claim 18, wherein the second blister pack holding section has at least one hole therethrough positioned in a pattern that corresponds to an arrangement of at least one blister on a front side of a blister pack to be inserted into the blister pack pocket such that, when said blister pack is filly inserted in the blister pack pocket, each of said at least one blister projects outward from one of said at least one hole.

20. The display easel of claim 18, wherein the first blister pack holding section has at least one hole therethrough positioned in a pattern that corresponds to an arrangement of at least one blister pack information on a back side of a blister pack to be inserted in the blister pack pocket and the third blister pack holding section has at least one hole positioned in a pattern that corresponds to an arrangement of said at least one blister pack information on the back side of the blister pack to be inserted in the blister pack pocket such that, when said blister pack is fully inserted in the blister pack pocket, each of said at least one blister pack information is visible from the back side of the blister pack holding panel.

21. The display easel of claim 20, wherein the blister pack information comprises one of an expiration date of material in the blister pack, graphics, advertising, and a lot number of material in the blister pack.

22. The display easel of claim 18, wherein the cover panel has cover panel information, said cover panel information being one of attached to and printed on a side of the cover panel.

23. The display easel of claim 22, wherein the cover panel information comprises one of graphics, advertising, and information about material in a blister pack which is inserted in the pocket of the blister pack holding panel.

24. The display easel of claim 18, wherein the base has a fold line such that, when the base is bent along said fold line, the display easel collapses into a form where the blister pack holding panel, the literature display panel, and the cover panel are substantially flattened against one another.

25. The display easel of claim 18, wherein a slit is formed in the second literature display section whereby an additional pocket is formed when the first and second literature display sections are folded together to form the literature display panel.

26. The display easel of claim 18, wherein the cover panel comprises:

a first cover section having a bottom edge and a top edge, said top edge being hingedly connected along a common fold line with the top edge of the third blister pack holding section;

a second cover section having a bottom edge being hingedly connected along a common fold line with the bottom edge of the first cover section;

whereby the cover panel is created by folding the first and second cover sections at their common fold line and attaching the second cover section and the first cover section.

27. The display easel of claim 18, wherein the tab on the outer edge of the second literature display section is folded over at the common fold line so as to be flush with a side of the second literature display section that is facing the front side of the first literature display section before attaching the second literature display section to the first literature display section.

28. The display easel of claim 18, wherein the tab on the outer edge of the second blister pack holding section is folded over at the common fold line so as to be flush with a side of the second blister pack holding section that is facing the front side of the first blister pack holding section before attaching the second blister pack holding section to the first blister pack holding section.

29. A freestandable blistered article protective exhibitor, comprising:

a first member having a top end and a bottom end and defining a first pocket for receiving a blister pack carrying at least an article contained in an outwardly-projecting enclosure of the blister pack, said first member having at least an opening defined therein for receiving, through said at least an opening, the outwardly-projecting enclosure of the blister pack when the blister pack is received in said first pocket to thereby retain the blister pack in said first pocket of the first member with the enclosure projecting through said at least an opening;

a second member having a bottom end and a top end pivotally connected to the first member top end and defining a second pocket for receiving the at least a second article related to the at least a first article;

an adjustable member connecting the first member bottom end and the second member bottom end and adjustable between a first position in which said first and second members are disposed in substantial surface-to-surface overlapping adjacency and a second position in which said first member bottom end and said second member bottom end are spaced apart so that said first and second members form a freestanding easel with said first and second member bottom ends supported on an underlying support surface; and a third member having a bottom end and a top end pivotally connect to the first and second member top ends and pivotally movably about said connection of the third member between a first position in which said third member overlies said first member and a second position in which said third member overlies second member.

30. A freestandable blistered article protective exhibitor in accordance with claim 29, wherein said adjustable member is integral with one of said first and second members and is releasably attachable to the other of said first and second members.

31. A freestandable blistered article protective exhibitor in accordance with claim 29, wherein said adjustable member comprises a flap that is foldable to compress the adjustable member to attain said first position and unfoldable to extend the adjustable member to said second position.

32. A freestandable blistered article protective exhibitor in accordance with claim 29, wherein the at least a second article is literature and said second pocket is at least one of sized and located to receive and retain literature relating to the at least a second article.

33. A freestandable blistered article protective exhibitor in accordance with claim 29, wherein said first, second, third and adjustable members are unitarily formed from a single sheet-like member that is predeterminately configured and folded to define said blistered article protective exhibitor.

34. A freestandable blistered article protective exhibitor in accordance with claim 29, wherein said third member carries printed information relating to the at least a first article and located so as to be viewable when said third member is disposed in said first position of the third member.

35. A freestandable blistered article protective exhibitor in accordance with claim 34, wherein the at least a second article is literature and said second pocket is at least one of sized and located to receive and retain literature relating to the at least a second article.

36. A freestandable blistered article protective exhibitor in accordance with claim 29, wherein the blister pack carries a plurality of the firs t articles each contained in a corresponding one of a plurality of outwardly-projecting enclosures, and wherein said first member has a plurality of openings defined therein so that, when the blister card is received in said first pocket, each of the first article-carrying enclosures projects through a respective one of said plural openings.

* * * * *